United States Patent [19]

Cameron

[11] Patent Number: 4,571,563

[45] Date of Patent: Feb. 18, 1986

[54] INTEGRATED MICROWAVE FILTER AND METHOD OF CONSTRUCTING SAME

[75] Inventor: Richard J. Cameron, Noordwijk, Netherlands

[73] Assignee: Agence Spatiale Europeenne, Paris, France

[21] Appl. No.: 573,060

[22] Filed: Jan. 23, 1984

[30] Foreign Application Priority Data

Nov. 18, 1983 [BE] Belgium ..... 0/211894

[51] Int. Cl.[4] ..... H01P 1/208; H01P 1/161

[52] U.S. Cl. ..... 333/212; 333/209; 333/230

[58] Field of Search ..... 333/202, 206-207, 333/208-212, 222, 223, 224-235, 239, 248, 251

[56] References Cited

U.S. PATENT DOCUMENTS 3,697,898 10/1972 Blachier et al. ..... 333/209 X
4,135,133 1/1979 Mok ..... 333/212 X

OTHER PUBLICATIONS

J. D. Rhodes, "A Low-Pass Prototype Network for Microwave Linear Phase Filters," *IEEE MTT,* vol. 18, pp. 290-301, Jun. 1970.

A. E. Atia & A. E. Williams, "New Types of Waveguide Bandpass Filters for Satellite Transponders," *Comsat Tech. Rev.,* vol. 1, No. 1, 1971.

R. J. Cameron, "Computer Aided Design of Advanced Microwave Filters," *Spacecad '79, Proc. Int. Symposium,* Nov., 1979.

G. Pfitzenmaier, "An Exact Solution for a Six-Cavity Dual-Mode Elliptic Bandpass Filter," *Proc. 1977 Int. Microwave Symp.,* pp. 400-403.

Seymour B. Cohn, "Determination of Aperture Parameters by Electrolytic-Tank Measurements," *Proc. of the IRE,* 1416-1421, Nov. 1951.

Seymour B. Cohn, "The Electric Polarizability of Apertures of Arbitrary Shape," *Proc. of the IRE,* 1069-1071, Sep. 5, 1952.

Cameron et al.-"The Analysis, Synthesis and Multiplexion of Bandpass Dual-Mode Filters", ESA Journal (1977), vol. 1, No. 2; pp. 177-188.

Williams et al.-"Dual-Mode Canonical Waveguide Filters" IEEE Trans. on Microwave Theory and Techniques, vol. MTT-25, No. 12, Dec. 1977; pp. 1021-1026.

*Primary Examiner*—Marvin L. Nussbaum
*Attorney, Agent, or Firm*—Fred A. Keire

[57] ABSTRACT

Cascaded dual-mode resonance cavities are separated by plates having each a cruciform iris therein, the arms of which have lengths determined by a direct and precise procedure starting from a conventional Butterworth prototype filter. The transfer function parameters are altered to change the filter response and the group delay performance is determined and compared to an ideal flat response for producing a penalty function signal from the difference in order to modify the parameters again in such direction that the penalty function signal is likely to be reduced. The process is repeated until the penalty function signal is minimum, whereby a compact structure is realized which provides an attenuation response having sharp cut-off slopes at the edges of the signal bandwidth together with a close to flat in-band group delay response.

2 Claims, 23 Drawing Figures

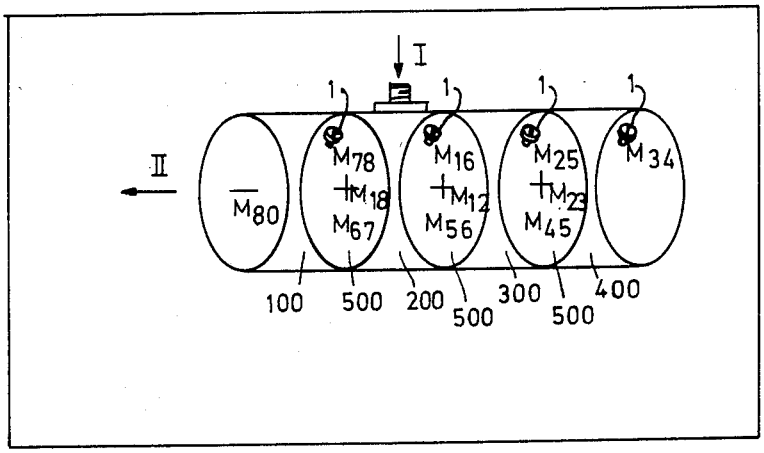
FIG. 1
FIG. 2
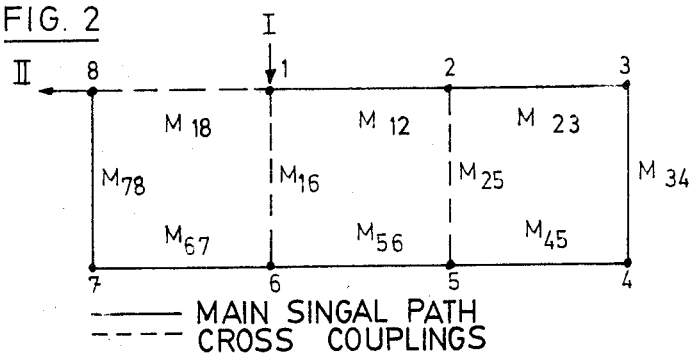
FIG. 3
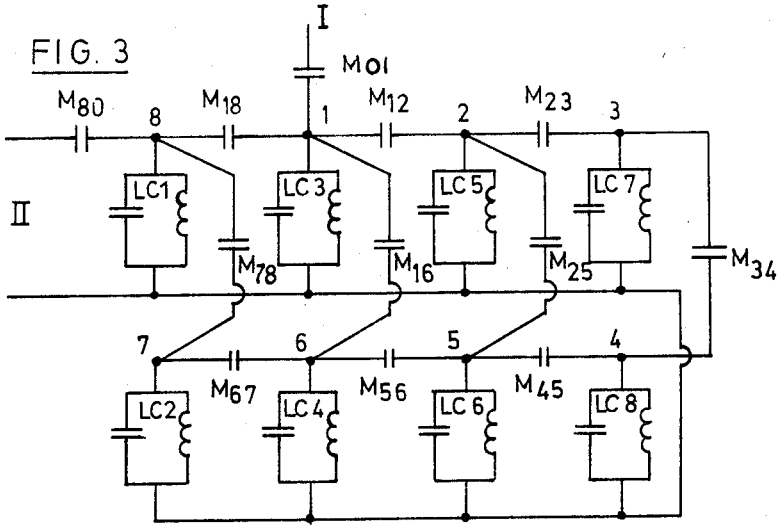

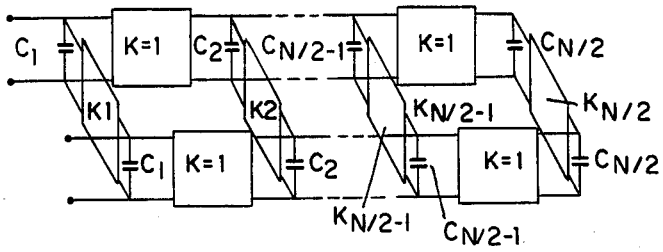
FIG. 14
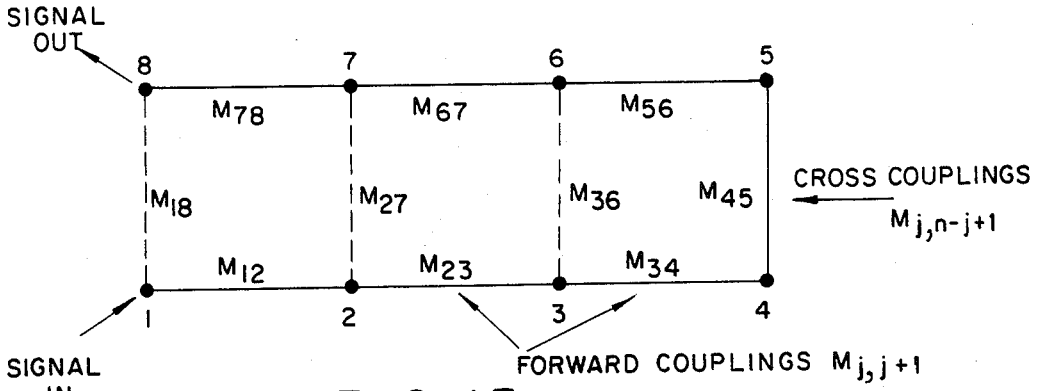
FIG. 15
| | 1 | 2 | 3 | 4 | 5 | 6 | 7 | 8 |
|---|---|---|---|---|---|---|---|---|
| 1 | | $M_{12}$ | | | | | | $M_{18}$ |
| 2 | $M_{12}$ | | $M_{23}$ | | | | $M_{27}$ | |
| 3 | | $M_{23}$ | | $M_{34}$ | | $M_{36}$ | | |
| 4 | | | $M_{34}$ | | $M_{45}$ | | | |
| 5 | | | | $M_{45}$ | | $M_{56}$ | | |
| 6 | | | $M_{36}$ | | $M_{56}$ | | $M_{67}$ | |
| 7 | | $M_{27}$ | | | | $M_{67}$ | | $M_{78}$ |
| 8 | $M_{18}$ | | | | | | $M_{78}$ | |
FIG. 16

| PHYSICAL CAVITY NO | | 1 | 2 | 3 | 4 |
|---|---|---|---|---|---|
| CONTAINING ELECTRICAL RESONANCE NUMBERS: | VERTICAL POLARISATION | 8 | 7 | 6 | 5 |
| | HORIZONTAL POLARISATION | 1 | 2 | 3 | 4 |

| PHYSICAL CAVITY NO | | 1 | 2 | 3 | 4 |
|---|---|---|---|---|---|
| CONTAINING ELECTRICAL RESONANCE NUMBERS: | VERTICAL POLARISATION | 2 | 3 | 6 | 7 |
| | HORIZONTAL POLARISATION | 1 | 4 | 5 | 8 |

| | 1 | 2 | 3 | 4 | 5 | 6 | 7 | 8 |
|---|---|---|---|---|---|---|---|---|
| 1 | | $M_{12}$ | | $M_{14}$ | | | | |
| 2 | $M_{12}$ | | $M_{23}$ | | | | | |
| 3 | | $M_{23}$ | | $M_{34}$ | | $M_{36}$ | | |
| 4 | $M_{14}$ | | $M_{34}$ | | $M_{45}$ | | | |
| 5 | | | | $M_{45}$ | | $M_{56}$ | | $M_{58}$ |
| 6 | | | $M_{36}$ | | $M_{56}$ | | $M_{67}$ | |
| 7 | | | | | | $M_{67}$ | | $M_{78}$ |
| 8 | | | | | $M_{58}$ | | $M_{78}$ | |

| | 1 | 2 | 3 | 4 | 5 | 6 | 7 | 8 |
|---|---|---|---|---|---|---|---|---|
| 1 | 1 | | | | | | | |
| 2 | | COS θ | | | | SIN θ | | |
| 3 | | | 1 | | | | | |
| 4 | | | | 1 | | | | |
| 5 | | | | | 1 | | | |
| 6 | | -SIN θ | | | | COS θ | | |
| 7 | | | | | | | 1 | |
| 8 | | | | | | | | 1 |

| | 1 | 2 | 3 | 4 | 5 | 6 | 7 | 8 |
|---|---|---|---|---|---|---|---|---|
| 1 | | $M'_{12}$ | | | | $M'_{16}$ | | $M'_{18}$ |
| 2 | $M'_{12}$ | | $M'_{23}$ | | $M'_{25}$ | | | |
| 3 | | $M'_{23}$ | | $M'_{34}$ | | $M'_{36}$ | | |
| 4 | | | $M'_{34}$ | | $M'_{45}$ | | | |
| 5 | | $M'_{25}$ | | $M'_{45}$ | | $M'_{56}$ | | |
| 6 | $M'_{16}$ | | $M'_{36}$ | | $M'_{56}$ | | $M'_{67}$ | |
| 7 | | | | | | $M'_{67}$ | | $M'_{78}$ |
| 8 | $M'_{18}$ | | | | | | $M'_{78}$ | |

FIG. 23

INTEGRATED MICROWAVE FILTER AND METHOD OF CONSTRUCTING SAME

BACKGROUND OF THE INVENTION

The present invention relates to the construction of microwave filters having sharp frequency selectivity together with a flat or nearly-flat group delay characteristic. A filter of this type is useful for instance for use as a channel filter for the demultiplexers in the multibeam payload of a baseband-processing SS-TDMA communication satellite in order to limit noise and adjacent channel interference prior to demodulation.

The required specifications for a bandpass filter are usually divided into three groups: those concerning out-of-band rejection and in-band amplitude linearity, those for group delay and those for input/output match (return loss). The ideal filter will have flat group delay from 0 to infinite frequency, a rectangular amplitude response and perfect match (i.e. infinite return loss) at the ports. Such characteristics in a passive finite device are impossible though and the best that can be done is to approach them through devices which increase in complexity the nearer the ideal is approached. Chebychev filters are useful for satisfying tight rejection and match specifications, but always at the expense of severe group delay non linearities particularly at the band edges. Self-equalization partly solves the problem by linearizing the central 70–80% portion of the group delay characteristic, but the characteristic still exhibits substantial deviations or ears at the band edges. This may be damaging to data signals, even though only a small proportion of the spectrum falls within said ears, since it is these portions of the spectrum that contain the data clock frequency information. The degradations are exacerbated spectacularly when the delay distortions are asymmetric to the signal frequency, i.e. when the filter center frequency drifts under a temperature change.

For these reasons, therefore, it is better to have a flat or nearly-flat group delay characteristic over the entire passband, and a bit more if possible to account for real-world drift of the filter characteristics relative to the signal spectrum. In realizing electric filters, however, the implementation of a sharp frequency selectivity and a flat group delay characteristic generates conflicting design requirements and using conventional elementary prototype filter does not allow to fit both specifications simultaneously.

One solution to fit both of these specifications is to implement a composite filter as described by W. M. Childs, P. A. Carlton, R. Egri, C. E. Mahle and A. E. Williams in "A 14 GHz Regenerative Receiver For Spacecraft Application" (5th International Conference on Digital Satellite Communications, Mar. 20–26, 1981, Genova, Italy, p. 453–459). This composite filter comprises a Bessel bandpass filter and an elliptic bandpass filter operating in cascade via an isolator. The rounded amplitude response and the flat group delay are developed by the Bessel filter and the sharp frequency selectivity feature is developed by the elliptic filter. The authors have disclosed the performance of an exemplary design comprising a 4th degree 72 MHz bandpass Bessel filter with a 6th degree 78 MHz bandpass pseudo-elliptic filter. The major disadvantages of this type of filter lie in its dimensions in view of its cascaded filters interconnected by an isolator, and as a result also in its weight. Both disadvantages become more serious when considered in terms of payload size and weight implications for application in artificial satellites. Furthermore, this type of filter lacks flexibility, since it is limited to particular transmission characteristics. Finally, the filter, in view of its structure equivalent to 10th degree, and its isolator, introduces considerable electrical losses.

SUMMARY OF THE INVENTION

The invention solves the problem of realizing microwave filters having simultaneously a sharp frequency selectivity and a flat or nearly-flat group delay characteristic while having a compact size and a light weight to allow it to be used in artificial satellites.

The object of the invention is achieved by an integrated microwave filter structure comprising a cascade of dual-mode resonance cavities in which the adjacent cavities are coupled by means of cruciform coupling irises, the arms of which have lengths determined by a novel and precise procedure as described in the appended claims.

BRIEF DESCRIPTION OF THE DRAWINGS

FIG. 1 depicts an exemplary embodiment of dual-mode resonance cavity filter structure.

FIG. 2 shows the coupling and routing diagram of the structure of FIG. 1.

FIG. 3 shows the electric equivalent circuit of the structure of FIG. 1.

FIG. 14 is a schematic diagram of a folded ladder network of admittance inverters and shut capacitors that are cross connected.

FIG. 15 is a coupling and routing diagram for the network shown in FIG. 14.

FIG. 16 is a coupling matrix for the network shown in FIG. 14.

FIG. 23 depicts the coupling matrix of FIG. 16 after a first rotation.

DESCRIPTION OF AN EXEMPLARY EMBODIMENT

Figure 4:
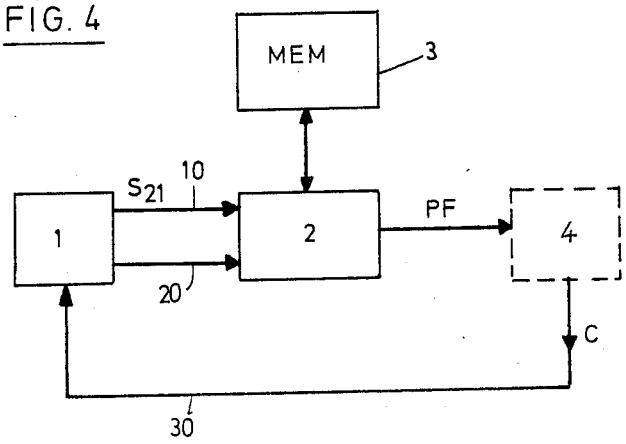
FIG. 4 is a block diagram of a processor-based system used to automatically determine the construction parameters of a microwave filter structure according to the invention.

Referring to FIG. 1, there is shown a four dual-mode cavity structure. This is an in-line structure including four cylindrical resonant cavities 100, 200, 300, 400 separated by iris plates 500 having each a cruciform coupling iris 5 therein. Each cavity supports two $TE_{111}$ mode resonances, polarized orthogonally to each other, with each resonance being tuned individually by means of a tuning screw. The two resonances in each cavity are coupled to each other by means of a coupling screw 1 at 45° to the corresponding tuning screws. The input and output ports I and II respectively are in adjacent cavities.

FIG. 2 shows the routing and cross-coupling diagram of the structure of FIG. 1. The dots represent the resonance modes and the references Mij denote the resonance mode couplings realized. The main signal path is shown in continuous line and the cross-coupling paths are shown in broken line.

FIG. 3 shows the equivalent electrical circuit of the structure of FIG. 1. This is a folded ladder network of resonant LC circuits interconnected by coupling capacitors. The LC circuits represent the cavity resonances: $LC_1$ and $LC_2$ for the cavity 100, $LC_3$ and $LC_4$ for the cavity 200, $LC_5$ and $LC_6$ for the cavity 300, $LC_7$ and $LC_8$ for the cavity 400. The resonant circuits are all synchronously resonant at the geometric center frequency of the filter passband. The couplings between the two resonance modes in each cavity are denoted $M_{78}$, $M_{16}$, $M_{25}$ and $M_{34}$ respectively. The cross-couplings between resonance modes in adjacent cavities are denoted $M_{18}$ and $M_{67}$ between the cavities 100 and 200, $M_{12}$ and $M_{56}$ between the cavities 200 and 300, $M_{23}$ and $M_{45}$ between the cavities 300 and 400. The references $M_{01}$ and $M_{80}$ denote the input and output couplings respectively.

Each of the resonance mode couplings Mij has a corresponding device in the dual mode structure to realize that coupling: in this case coupling screws at 45° to the resonance tunings (forward couplings) or horizontal or vertical slots in the plates separating the dual mode cavities (cross-couplings). It is these cross-couplings between adjacent cavities that provide the required special features of the filter characteristics to be achieved to suit the particular application involved, i.e. attenuation poles (or transmission zeros), group delay equalization or a combination of both as will be discussed later herein. The more of these cross-couplings that can be realized in the structure, the greater is the number of attentuation poles that can be realized at finite frequencies and the better the group delay response will be equalized in accordance with this invention.

The purpose of the invention is to design the coupling irises so as to provide an attenuation response intended to correspond partly to the ideal Nyquist characteristic, combined with a flat or nearly flat group delay response over the signal bandwidth and a superior rejection performance close to the bandwidth edges.

The size of the coupling irises, it is known, is determined from the transfer function which represents the transmission characteristic of the filter. The transfer function is defined as a ratio of two finite polynomials in the frequency variable (s):

$$S_{21}=P(s)/\epsilon E(s)$$

where $\epsilon$ is a constant normalizing the amplitude to unity at its highest point. The singularities of the transfer function are the attenuation poles and the transmission poles. The attenuation poles or transmission zeros are merely the roots of the numerator polynomial P(s) whereas the transmission poles are the roots of the denominator polynomial E(s). The degree of polynomial P(s) increases as the attenuation poles or transmission zeros are brought down from infinity to finite locations in the complex s-plane. The cut-off slope at the bandwidth edges is altered by positioning the attenuation poles or transmission zeros at finite locations in the complex s-plane.

The transfer function $S_{21}$ is related to the reflection function $S_{11}$ through the principle of conservation of energy (lossless network), i.e.

$$|S_{21}|^2+|S_{11}|^2=1 \text{ with } S_{11}=F(s)/E(s)$$

Hence:

$$E(s)=[\epsilon^{-2}P^2(s)+F^2(s)]^{\frac{1}{2}} \quad (1)$$

Now the thinking behind the invention is to determine the size of the coupling irises based on a new transfer function having such transmission zeros at finite locations in the complex s-plane that it provides sharp cut-off slopes at the bandwidth edges together with a self-equalized in-band group delay characteristic over the signal bandwidth.

The new transfer function is determined in accordance with the process of this invention from the transfer function polynomials of a prototype electrical network providing a maximally flat in-band attenuation response in the passband, known as Butterworth prototype. Such a prototype network has attenuation poles at infinite frequency only (P(s)=1) and consequently it does not provide sharp cut-off slopes. The purpose of this invention is to set some transmission zeros (attenuation poles) at initial finite locations in the s-plane and to modify automatically the transfer function of this prototype network to define a new tailored transfer function for sizing the coupling irises of the filter structure so that it provides a flat or nearly-flat group delay characteristic, yet still retaining improved rejection slopes at the band edges thereby to fit the requirements for use in satellite telecommunications as mentioned hereinbefore.

Turning now to FIG. 4, there is shown a processor-based system arranged in accordance with the invention to provide a properly tailored transfer function.

The system includes an input unit 1 arranged and connected to generate the input signals on lines 10 and 20 to the processor 2 and to be responsive to a control signal on line 30. The procedure starts with the generation in the input unit 1 of the polynomials representing the transfer characteristic $S_{21}$ of a pure Butterworth prototype electrical network, i.e. a network providing a maximally flat in-band response in the signal frequency bandwidth.

These polynomials are supplied to the processor 2 which stores them in its memory section 3. Next, the positions of a number of transmission zeros at finite locations are generated and entered into the stored polynomials in order to modify the transfer characteristic $S_{21}$ of the network and produce attenuation poles in the direction of the imaginary axis of the complex s-plane. This has the effect of changing the group delay performance of the network, said group delay performance being determined by roots of the denominator polynomial E(s).

The processor 2 is programmed to compute the group delay characteristic of the network from the stored modified polynomials using the following formula:

$$\tau(s) = \frac{dE(s)}{ds} \cdot \frac{1}{E(s)} \quad (2)$$

where $\tau(s)$ denotes the group delay dE(s) denotes the differential of polynomial E(s).

For this computation the processor uses the value for E(s) that is derived from equation (1) with P(s)=1 and $F(s)=s^N$ for a pure Butterworth characteristic.

The modified group delay characteristic so computed is compared with a stored ideal flat group delay characteristic to produce the difference therebetween and generate a penalty function signal PF. This penalty function signal is used in a controller 4 to produce a control signal C for the input unit 1 so that it alters the locations of the transmission zeros to further modify the transfer characteristic $S_{21}$ in the processor 2 in such direction that said difference between the resultant group delay characteristic and the target group delay is likely to be reduced. The new penalty function in turn serves to control a new alteration of the transmission zero locations and the sequence described is repeated until the penalty function is reduced to a minimum value. At this point the group delay characteristic obtained with the latest locations of the transmission zeros will be as close as it is possible to get to the target group delay characteristic.

The modified transfer function thus produced is used in the usual way to determine the susceptances of the respective coupling irises of the filter structure as well as other construction parameters. Briefly, the procedure for determining the structure comprises two steps. The first step consists in converting the electrical network corresponding to the transfer function so determined into a coupling matrix, such as the one illustrated in FIG. 16. The second step consists in transforming the coupling matrix until it contains only couplings which can be realized by dual-mode resonance cavities and their coupling components. This procedure is developed in the following publication ESA Journal, Vol. 3, No. 4, 1979, pages 281–287: A Novel Realisation for Microwave Bandpass Filters, by R. J. Cameron, and discussed below. There are several ways to realize the coupling matrix of FIG. 16 directly in a waveguide. An advantageous method is to reconfigure the coupling matrix by applying a series of similarity transformations, which includes rotating the elements in the coupling matrix with pivot coordinates.

Finally, the iris arms are cut to the lengths as determined corresponding to the determined susceptances and the assembled filter is tuned to the desired transmission characteristics by adjusting the coupling screws to provide for the correct coupling values.

Some years ago Rhodes, in a paper entitled "A Low-Pass Prototype Network for Microwave Linear Phase Filters," which was published in the *IEEE MTT,* Volume 18, dated June 6, 1970, postulated the Generalized Prototype Cross-Coupled Network for the low-pass realization of transfer characteristics which are mathematically defined by the ratio of two finite-order polynomials. The network, which is depicted in FIG. 14, is a folded ladder network of admittance inverters and shunt capacitors that are cross-connected by further inverters. FIG. 15 illustrates the diagram commonly used to represent the network.

Upon low-pass to bandpass transformation, the shunt capacitors are paralleled by inductors, thereby becoming resonant circuits all synchronously resonant at $f_o$, the geometric center of the bandpass filter. The inverters become coupling mechanisms, coupling between resonators. Since the resonators are all synchronously tuned, it is possible to represent the couplings between the resonators in a square matrix known as a coupling matrix, i.e., like the one shown in FIG. 16.

The coupling matrix is a table of all the electrical couplings between the resonators. All elements without an entry are assumed to be zero, i.e., no coupling between the corresponding two resonances. Beause these are reciprocal devices, the matrix is always symmetric about the principal diagonal (i.e., the coupling between resonances 4 and 5 is the same as that between 5 and 4, for example). In general, but not necessarily, the matrix is symmetric about the anti-diagonal as well, for folded configuration. An important exception to this would be single-ended filters for multiplexer applications.

Relating the diagram in FIG. 15 to the matrix, it is easy to see that the main couplings are those running parallel to the principal diagronal, i.e., $M_{12}$, $M_{23}$, $M_{34}$ . . . etc.

The weaker cross-couplings are those on the anti-diagonal, $M_{18}$, $M_{27}$ and $M_{36}$ in this case. They may be positive or negative, and some or all may be zero. It is these cross-couplings that give the special features to the filter characteristic, such as out-of-band attenuation poles or in-band group-delay equalization or both. The more of these cross-couplings that can be realized, the greater is the number of transmission zeros that can be brought from $\omega=\pm\infty$ in the complex-plane representation of the filter's transmission function $S_{21}(j\omega)$ and used to create the poles and equalization mentioned above. The folded configuration in fact has the maximum number of these finite zeros for a given order of filter, and is calculated from the equation:

$$n_{fz}=n-c \quad (3)$$

where $n_{fz}$=maximum number of finite transmission zeros, given the order and configuration of the filter;

n=order of the filter;

c=minimum number of electrical resonances between input and output (refer to coupling and routing diagrams, such as FIG. 15, to calculate c).

In the example of FIG. 15, n=8, c=2, and therefore in this case the maximum number of finite transmission zeros is 6. A configuration will be discussed below that, while it possesses certain realization advantages, has less than the maximum possible number of finite transmission zeros for the given order, and therefore diminished freedom to tailor the transmission characteristics to a tight specification.

Figure 17:
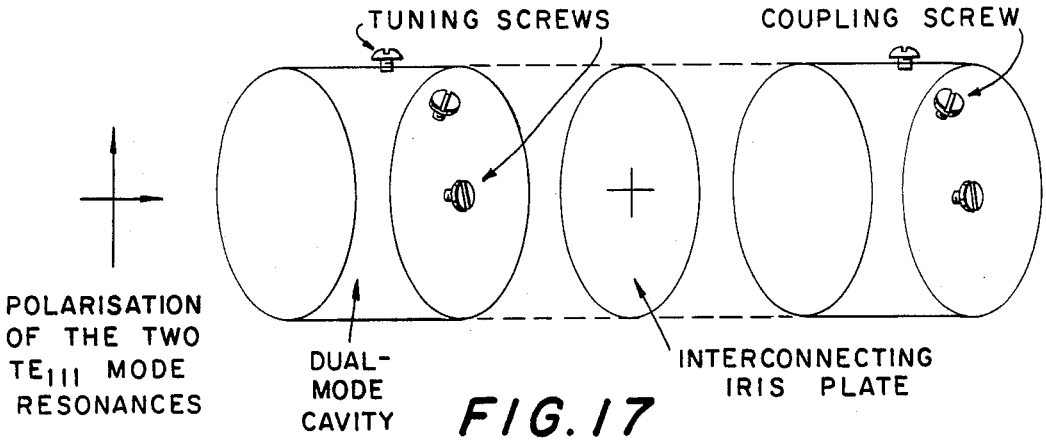
FIG. 17 is an exploded view of two dual-mode cavities with an interconnecting iris.

There are several ways to realize the matrix of FIG. 16 directly in a waveguide, and the most convenient of these is with dual-mode cylindrical cavities, as indicated in a paper by A. E. Atia and A. E. Williams entitled "New Types of Waveguide Bandpass Filters for Satellite Transponders," which was published in volume 1 of the *COMSAT Technical Review*. The reasons for this are that these cavities are less lossy than their square or rectangular counterparts and that negative couplings are easily accommodated. Each cavity contains two $TE_{111}$-mode resonances, existing orthogonally and independently of each other, as shown in FIG. 17.

Figure 18:
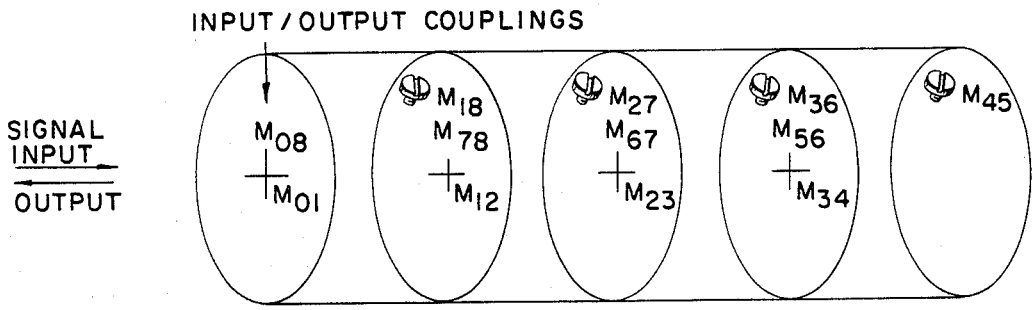
FIG. 18 is a diagrammatic illustration of a reflective dual-mode filter.

The two resonances within one cavity are coupled to each other with a coupling screw at 45° to the tuning screws. The resonances are connected between cavities by cross-shaped irises. Relating this form of construction back to the coupling matrix of FIG. 16, it is apparent that the couplings can be realized with a structure of the type shown in FIG. 18.

Whilst this structure realizes the maximum number of cross-couplings possible for the given order, it has two major disadvantages. The main signal path is from the input through the cavities in one polarization until cavity 4. Here it is coupled to the orthogonal resonance in cavity 4 by a screw $M_{45}$, and then it propagates back through the cavities with this same polarization until it emerges at the output. The first problem is to separate the ingoing and outcoming orthogonally polarized signals, and the second is one of input/output isolation in the reject bands of this bandpass filter. Experiments have shown that the maximum isolation attainable in practice is in the order of 20–25 dB, which is not good enough for most applications.

Figure 19:
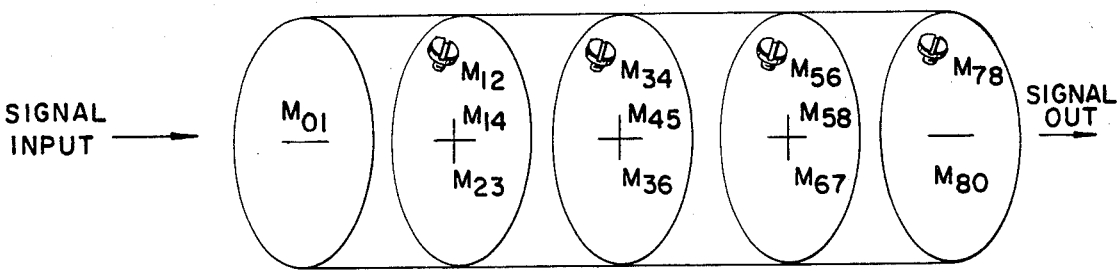
FIG. 19 is a diagrammatic illustration of a propagating dual-mode filter.

A better solution, avoiding both problems, is to reconfigure the coupling matrix in such a way that the input and output irises are at opposite ends of the filter, as illustrated in FIG. 19.

Figures 20, 21, 22:
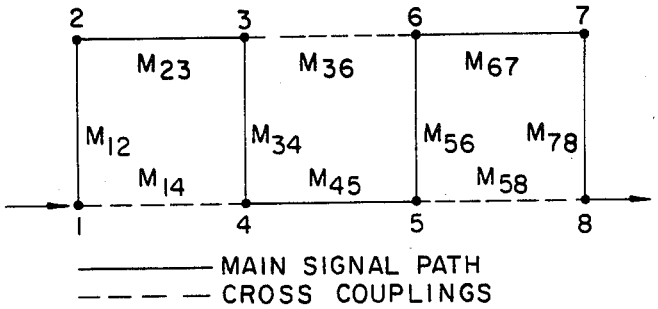
FIG. 20 is a coupling and routing diagram for the filter shown in FIG. 19.
FIG. 22 is an example of an $8\times8$ rotation matrix with a pivot at [2,6].

Note that the electrical resonances are redistributed among the cavities; cavity 1 now contains resonances 1 and 2, etc. The method by which the coupling matrix of FIG. 20 is derived from the folded configuration matrix of FIG. 16 has been the subject of much mathematical study, and a variety of explicit solutions now exist for even-ordered filters from 4 to 14 inclusive. A paper by R. J. Cameron entitled "Computer-Aided Design of Electronics for Space Applications," which was published in *Spacecad* '79 Proc. International Symposium, Bologna, Italy, 19–21 Sept. 1979, ESA Special Publication SP-146, November 1979, deals with a specific eighth-order example.

This propagating configuration, although eliminating the isolation and input/output separation problems, is able to realize fewer finite transmission zeros than the folded configuration. Referring to Equation (3) and FIG. 21, $c=4$ and therefore $n_{fz}=4$ compared with the six of the eighth-order folded configuration. This prevents the realization in this form of certain useful characteristics which require the maximum number of finite transmission zeros available for the order. A configuration will now be described that is able to realize the maximum available $n_{fz}$ and also avoids the isolation and signal-separation problems.

A rotation matrix R is defined as in FIG. 22.

Pivot [m,n] means that $R_{mm}=R_{nn}=\cos\theta$ and $R_{mn}=-R_{nm}=\sin\theta$. If a coupling matrix M is pre-multiplied by R and the result post-multiplied by $R_T$ (the transpose of R), a new matrix M′ will result which is mathematically identical to the original M:

$$M'=R\cdot M\cdot R^T \tag{4}$$

If this process is applied, with M the coupling matrix of FIG. 16, R the rotation matrix of FIG. 22 and tan $\theta_1=(-M_{27}/M_{67})$, the coupling matrix M′ of FIG. 23 will result. The coupling $M'_{27}$ has been annihilated and two more $M'_{16}$ and $M'_{25}$, have been created.

Another rotation is now applied, this time with the pivot of the rotation matrix at [3,5] and tan $\theta=(-M'_{36}/M'_{56})$, and the coupling matrix shown in Table 2, on page 14, results. Should the couplings of such a coupling matrix be realized, an electrical characteristic will result which is identical to that produced by the originally realized coupling matrix M. In general, if the order of the filter is n (n=even integer≧6):

Number of rotations required $r=(n-4)/2$ $$\left.\begin{array}{ll} \text{for the } k\text{-th rotation, pivot} = [i,j] & i = k+1 \\ & j = n-i \\ \theta_k = \tan^{-1}(-M_{i,n-k}/M_{j,n-k}) & \end{array}\right] k = 1 \rightarrow r$$

where $M_{i,j}$ is a coupling element from the matrix resultant from the previous rotation. This process is very easy to program and run on a computer.

A paper by G. Pfitzenmaier entitled "An Exact Solution for a Six-Cavity Dual-Mode Elliptic Bandpass Filter," which was published in *Proc.* 1977 *International Microwave Symposium*, San Diego, on pages 400–403, notes that it is possible to realize all the couplings of Table 2 with a dual-mode structure, as shown in FIG. 1.

Because the input and output ports are in adjacent cavities, there is no problem with input/output signal separation and input/output isolation. Furthermore, with reference to FIG. 2 and application of Equation (3), the maximum number of finite transmission zeros may be achieved ($n_{fz}=6$), allowing maximum flexibility in realizing complicated characteristics and tight specifications.

Figure 5:
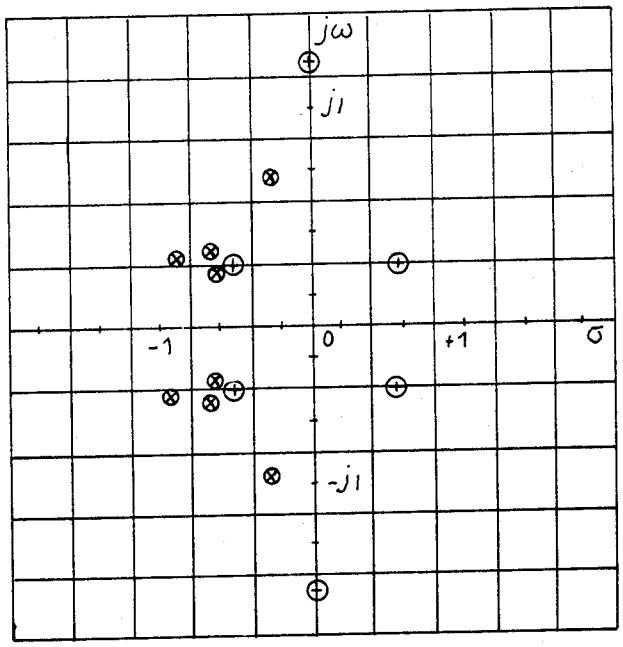
FIG. 5 is an illustration of the complex plane showing the locations of the singularities of the transfer function of an exemplary embodiment of the invention.

An eighth-degree embodiment of the present invention has been implemented with a 64 MHz passband for a center frequency of 14.125 GHz. This embodiment has a mass of approximately 120 g with dimensions 10×4×4 cm. The constructional features of this implementation are determined according to the following. The locations of the transmission poles (p) and zeros (z) in the complex s-plane are in accordance with Table 1 and as shown in FIG. 5. The Tables 2 and 3 respectively show the coupling matrix and the corresponding electrical susceptances required of the coupling elements in order to obtain the desired transfer characteristic. In Table 2, the couplings Mij are indicated at the intersections of rows and columns which are identified by digits 1 to 8 corresponding to the junction points in the routing diagram of FIG. 2.

TABLE 1

| | Real part | Imaginary part |
|---|---|---|
| $p_{1'8}$ | −0.268 | ±0.968 |
| $p_{2'7}$ | −0.535 | ±0.374 |
| $p_{3'6}$ | −0.559 | ±0.446 |
| $p_{4'5}$ | −0.889 | ±0.431 |
| $z_{1'2}$ | 0 | ±1.71 |
| $z_{3'4'5'6}$ | ±0.551 | ±0.398 |
| $z_{7'8}$ | 0 | ±infini |

TABLE 2

| | 1 | 2 | 3 | 4 | 5 | 6 | 7 | 8 |
|---|---|---|---|---|---|---|---|---|
| 1 | | $M_{12}$ | | | | $M_{16}$ | | $M_{18}$ |
| 2 | $M_{12}$ | | $M_{23}$ | | $M_{25}$ | | | |
| 3 | | $M_{23}$ | | $M_{34}$ | | | | |
| 4 | | | $M_{34}$ | | $M_{45}$ | | | |
| 5 | | $M_{25}$ | | $M_{45}$ | | $M_{56}$ | | |
| 6 | $M_{16}$ | | | | $M_{56}$ | | $M_{67}$ | |
| 7 | | | | | | $M_{67}$ | | $M_{78}$ |

TABLE 2-continued

| | 1 | 2 | 3 | 4 | 5 | 6 | 7 | 8 |
|---|---|---|---|---|---|---|---|---|
| 8 | $M_{18}$ | | | | | | $M_{78}$ | |

TABLE 3

| | |
|---|---|
| $M_{12}$ | 60.04 |
| $M_{16}$ | 800.36 |
| $M_{18}$ | −1045.81 |
| $M_{23}$ | 133.93 |
| $M_{25}$ | 328.77 |
| $M_{34}$ | 266.25 |
| $M_{45}$ | 164.04 |
| $M_{56}$ | 150.90 |
| $M_{67}$ | 121.02 |
| $M_{78}$ | 59.87 |

TABLE 4

| Iris No. | Between cavities | | Coupling | Susceptance | Length (mm) |
|---|---|---|---|---|---|
| 1 | 1 | 2 | $M_{18}$ | 1045 | 2.36 |
| | | | $M_{67}$ | 121.0 | 4.49 |
| 2 | 2 | 3 | $M_{12}$ | 60 | 5.47 |
| | | | $M_{56}$ | 151 | 4.21 |
| 3 | 3 | 4 | $M_{23}$ | 134 | 4.36 |
| | | | $M_{45}$ | 164 | 4.11 |

The electrical susceptance values indicated in Table 3 are realized as cruciform irises or screws. The coupling screws are adjusted for their correct coupling values during turning, but the irises are cut beforehand. In the case of the eighth order embodiment, the lengths of the two arms of each iris have been adjusted after the values indicated in Table 4. The susceptance value of the output iris is $M_{80}=8.7$ and the length of the slot is 8.41 mm.

Figure 6:
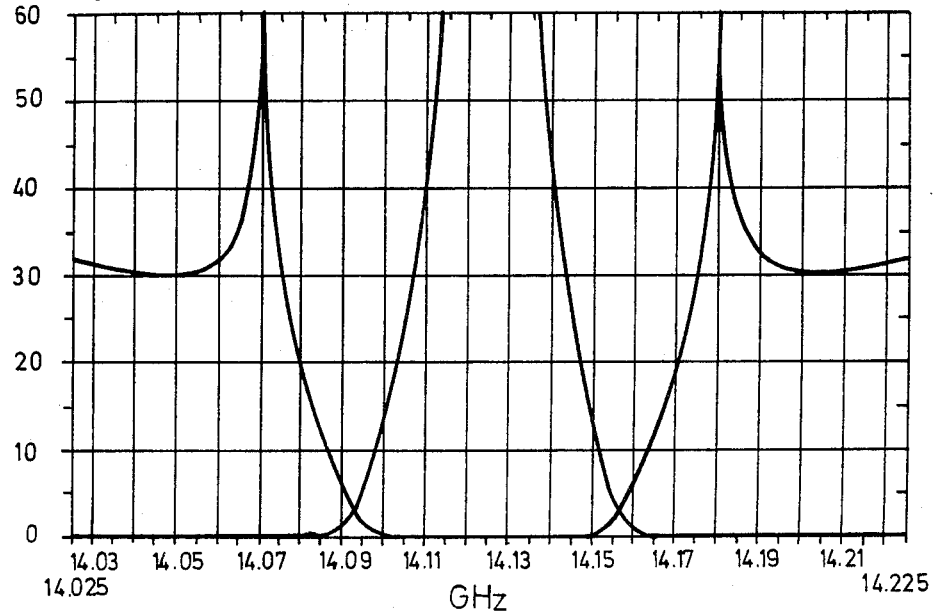
FIGS. 6 and 7 show the amplitude and group delay characteristics respectively provided by an exemplary embodiment of this invention.
Figure 7:
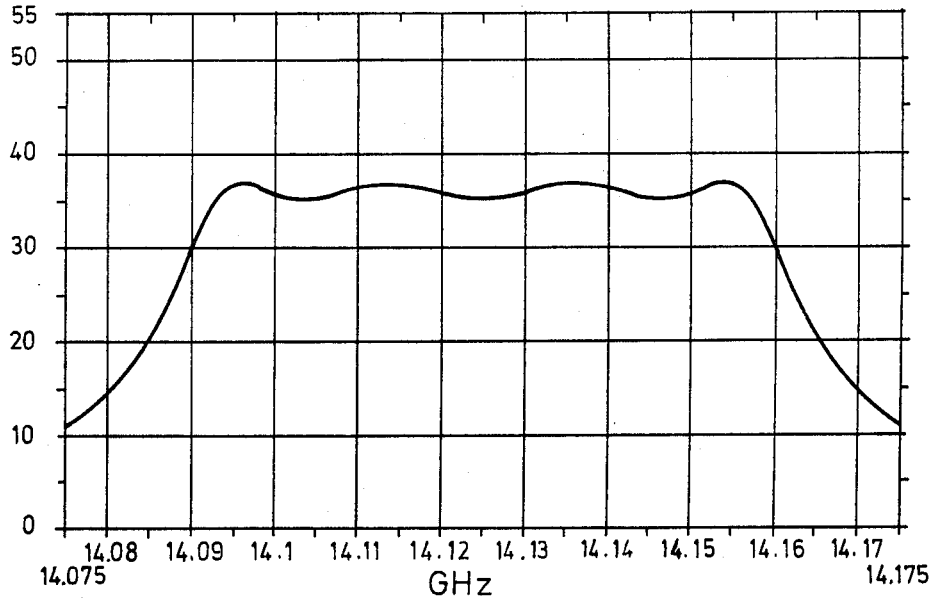

The amplitude and group delay characteristics provided by this implementation are shown in FIGS. 6 and 7. It may be seen from FIG. 6 that the in-band attenuation response is maximally flat with a sharp close-to-band-edge rejection rate. FIG. 7 shows that the group delay characteristic is almost equiripple with a ripple of about 2.1 ns peak-to-peak over a 64 MHz bandwidth, which happens to be the 3 dB bandwidth.

Figure 8:
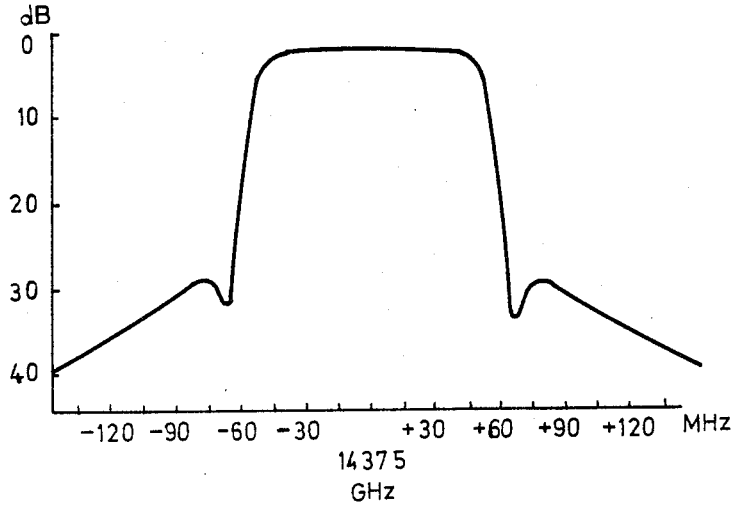
FIGS. 8 and 9 show the amplitude and group delay characteristics respectively provided by an equivalent conventional Chebychev filter.
Figure 9:
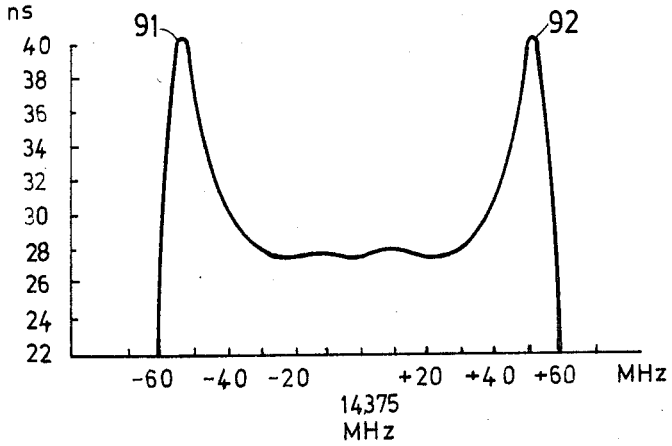

These characteristics provided by the exemplary implementation according to the invention are to be compared to those of an equivalent conventional Chebychev filter as shown in FIGS. 8 and 9. Comparing the attenuation response of FIG. 6 with that of FIG. 8, it is clear that the close-to-band-edge rejection rate in FIG. 6 is very similar to, somewhat less than, the rejection rate of the Chebychev filter characteristic (FIG. 8). However, referring to FIG. 7, it is seen that the group delay characteristic provided by the invention compares favorably with that of the Chebychev group delay characteristic of FIG. 9 which exhibits the previously mentioned ears 91 and 92. On the contrary, the group delay characteristic of FIG. 7 does not exhibit such ears, leaving an equiripple delay characteristic which approximates the ideal flat shape as close as that could be achieved wih the available quartet of transmission zeros.

Figure 10:
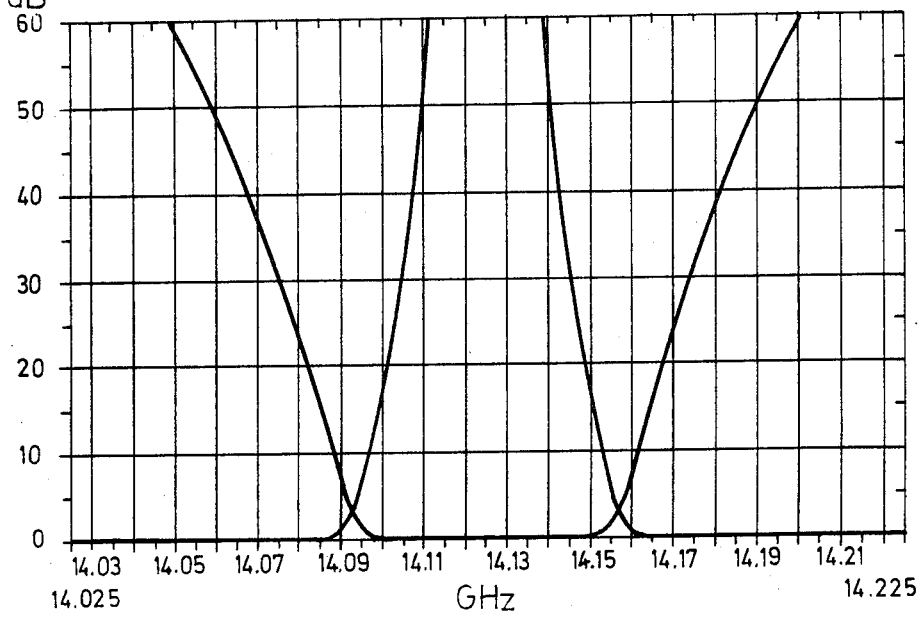
FIGS. 10 and 11 show the amplitude and group delay characteristics respectively provided by a conventional pure Butterworth filter.
Figure 11:
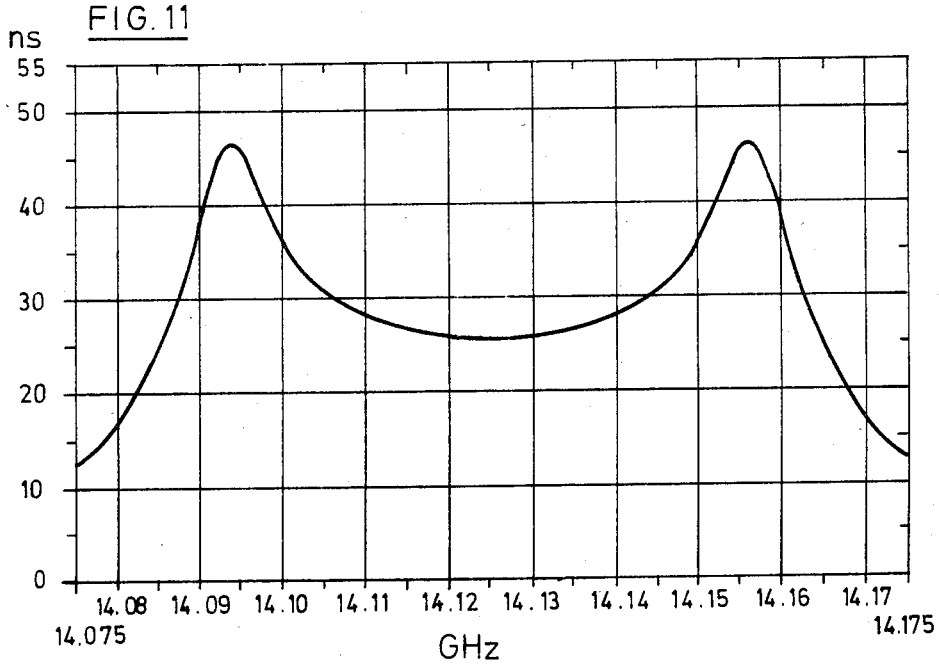
Figure 12:
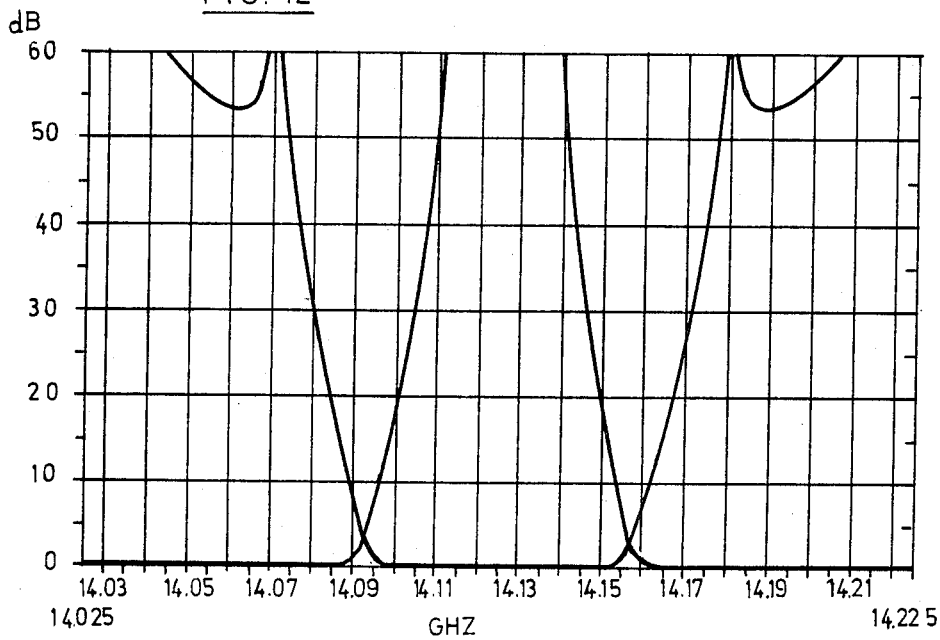
FIGS. 12 and 13 show the amplitude and group delay characteristics respectively provided by a non-equalized elliptic filter.
Figure 13:
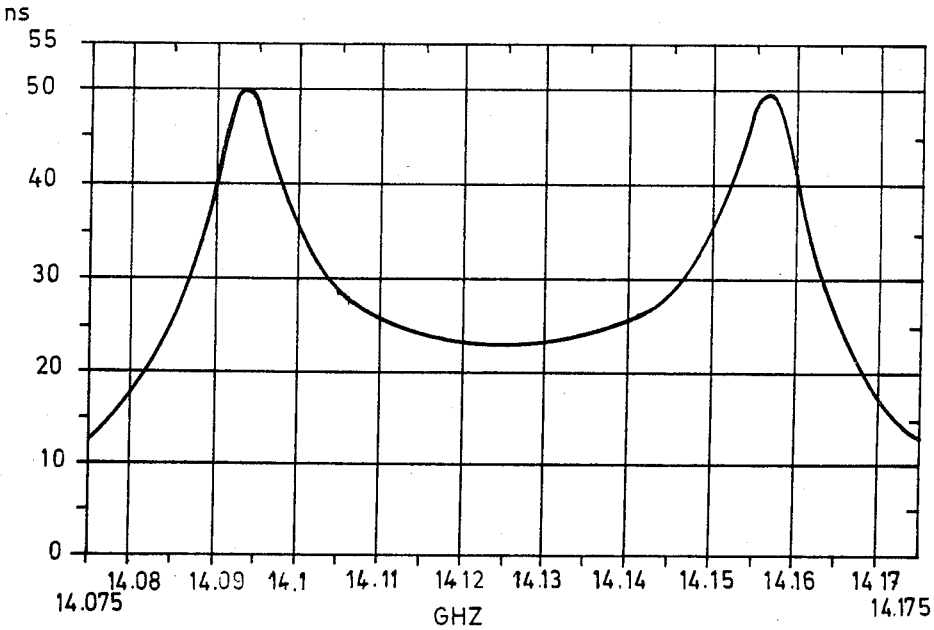

By way of further comparison, the corresponding attenuation and group delay characteristics provided by a conventional eighth-order pure Butterworth filter are shown in FIGS. 10 and 11 and those provided by an equivalent unequalized elliptic Butterworth filter are shown in FIGS. 12 and 13. All the characteristics are drawn on the same scale to facilitate comparison. It may be seen that the pure Butterworth characteristics (FIGS. 10–11) display gentle rejection slopes with transmission poles at infinity and a greater group delay deviation than with the filter of the invention. The elliptic filter characteristics of FIGS. 12 and 13 display better cut-off slopes than those provided by the pure Butterworth but a greater group delay deviation from the ideal flatness than the pure Butterworth characteristic. It may be seen that the attenuation characteristic shown in FIG. 12 is very similar to that of FIG. 6 and that the group delay characteristic of FIG. 13 exhibits greater deviation than that of FIG. 7 which is equalized by a singularity quartet having been added in accordance with the optimisation procedure of the invention. This group delay equalization is achieved at the expense of some reduction in rejection levels in the close-to-cut-off regions.

It is to be understood that this invention is applicable as well to cavity configurations of different orders than the exemplary embodiment described in the foregoing and to configurations having any other coupling and routing diagrams.

I claim:

1. A method of constructing an n-th degree microwave filter of the type formed of cascaded dual-mode rsonance cavities tuned to the geometric center frequency of the passband frequency range of the filter and with each cavity providing coupling between the resonance modes thereof and having cruciform irises for coupling adjacent cavities to each other, said method comprising the steps of:

(a) supplying to a data processing device the numerator and denominator polynomials representing the transfer characteristic of an ideal n-th degree Butterworth filter, (b) supplying to said data processing device finite locations on the complex s-plane of transmission zeros of said transfer characteristic for varying at least one of said numerator and denominator polynomials to modify said transfer characteristic and produce attenuation poles in the direction of the imaginary axis of said s-plane and change the group delay characteristic of said transfer characteristic, (c) determining the group delay characteristic of the modified transfer characteristic, (d) storing a desired group delay characteristic, (e) comparing said determined group delay characteristic to said stored group delay characteristic and producing a difference therebetween, (f) repeatedly altering the locations on the complex s-plane of said transmission zeros to further modify said transfer characteristic, said locations being altered in a direction to reduce said difference to a minimum value, (g) determining the susceptances of the respective cruciform irises as a function of the modified transfer characteristic which resulted in said minimum value difference, and (h) cutting the arms of the respective cruciform irises to lengths corresponding to said determined susceptances.

2. An n-th degree microwave filter comprised of cascaded dual-mode resonance cavities, means for tuning all of said cavities to the geometric center frequency of the passband frequency range of said filter, coupling means in each cavity to provide coupling between the resonance modes thereof, and respective cruciform irises provided between adjacent cavities for coupling one adjacent cavity to the next, the arms of said cruciform irises having lengths determined by:

(a) modifying the transfer characteristic of an ideal n-th degree Butterworth filter by varying at least one of the numerator and denominator polynomials of said transfer characteristic to represent finite locations on the complex s-plane of transmission zeros of said transfer characteristic, (b) determining the group delay characteristic of said modified transfer characteristic, (c) comparing said determined group delay characteristic to a desired group delay characteristic and producing a difference therebetween.

(d) altering the locations on the complex s-plane of said transmission zeros in a direction to reduce said difference to a minimum value, (e) determining the susceptances of the respective cruciform irises as a function of the modified transfer characteristic which resulted in the minimal difference, and (f) establishing the lengths of the arms of said respective cruciform irises in accordance with said determined susceptances.

* * * * *